United States Patent [19]

Poortman

[11] 4,131,280

[45] Dec. 26, 1978

[54] ELECTRONIC TEE OFF DEVICE

[76] Inventor: Karel A. Poortman, De Brei 4, Ingen, Netherlands

[21] Appl. No.: 754,979

[22] Filed: Dec. 28, 1976

Related U.S. Application Data

[63] Continuation-in-part of Ser. No. 590,689, Jun. 26, 1975, Pat. No. 4,000,904.

[30] Foreign Application Priority Data

Jul. 4, 1974 [NL] Netherlands ..... 7409067

[51] Int. Cl.[2] ..... A63B 69/36

[52] U.S. Cl. ..... 273/184 R; 273/186 C

[58] Field of Search ..... 273/35 R, 183 R, 183 E, 273/184 R, 184 A, 186 R, 186 C, 186 RA, 1 E, 179 A, 195 R, 138 A, 35, 183, 184, 186, 1, 179, 195, 138; 35/29 R, 29; 315/200 A, 209 R, 200, 209; 331/108 C, 108 D, 108; 340/82, 323 R, 325, 340, 379, 323

[56] References Cited

U.S. PATENT DOCUMENTS

| | | | |
|---|---|---|---|
| 1,637,339 | 8/1927 | Glennon et al. | 273/183 A X |
| 3,436,076 | 4/1969 | Barthol | 273/183 R X |
| 3,580,581 | 5/1971 | Raven | 273/138 A |
| 3,592,473 | 7/1971 | Jernakoff | 273/138 A |
| 3,834,710 | 9/1974 | Sousan | 273/138 A |
| 3,984,810 | 10/1976 | Hudson | 340/340 X |

OTHER PUBLICATIONS

*Practical Electronics;* "Heads & Tails"; vol. 12, No. 10.; Oct. 1976; p. 830.

*Digital Electronics with Engineering Applications;* Kuo, F. F.; 1970, p. 142.

*Primary Examiner*—Vance Y. Hum

*Attorney, Agent, or Firm*—Steinberg & Blake

[57] ABSTRACT

An electronic tee off device has a plurality of light-emitting diodes of different colors situated at a location where when energized, they are visible to a golfer when the golfer is properly positioned with respect to a golf ball which the golfer is about to drive from a tee. While the golf ball is carried by the tee a preparatory circuit is connected to the plurality of light-emitting diodes for sequentially placing them in a condition remaining unenergized but ready to be energized so that at any given instant the golfer has no way of knowing which particular light-emitting diode is conditioned to be energized. Upon driving the golf ball from the tee, the latter renders an operating circuit operative to energize whichever one of the light-emitting diodes happens to be in the condition to be energized, and this particular light-emitting diode is only momentarily energized so that the golfer, if properly positioned can detect a particular color of the particular light-emitting diode which is energized at the instant when the golf ball is driven from the tee.

11 Claims, 3 Drawing Figures

+4.5V
24

T
18
24
20
16
14
12
22

100K
+4.5V
MM74C73
MM74C908
MM74C14
D1
D2
CK
MS
I
II
III
47K
26
28
38
40
42
56Ω
1Ω
0.22μF
0.1μF
47K
B
T
BS
CS
F
C
10

ELECTRONIC TEE OFF DEVICE

CROSS REFERENCE TO RELATED APPLICATION

This application is a continuation-in-part of application Ser. No. 590,689, filed June 26, 1975, now U.S. Pat. No. 4,000,904.

BACKGROUND OF THE INVENTION

The present invention relates to tee-off devices for golf balls. In particular, the present invention relates to that type of tee-off device which aids the golfer in properly executing a stroke of the golf club.

When utilizing a tee-off device, the golf ball is positioned on the tee which is conventionally inserted into the ground, and subsequently the ball is driven from the tee with a golf club. A frequent error, however, is encountered in that the golfer when driving the ball does not keep his eye on the ball for a sufficiently long interval, which is to say until the moment of driving the ball from the tee. In other words, a frequent error encountered in executing the stroke of the golf club is that the golfer will raise his head, in order to follow the path taken by the ball, even before the ball has actually been struck by the golf club. As a result the golf stroke is not accurately carried out because when the golfer raises his head prior to actually striking of the golf ball the position of the shoulders of the golfer changes so that the golf club hits the ball in a manner differently from the initial intention when the golf swing was started.

SUMMARY OF THE INVENTION

It is a primary object of the present invention to provide a tee-off device which will avoid the above drawback.

Thus, is is an object of the present invention to provide a device of the above type which will enable a golfer to maintain his eye on the ball until the latter is struck.

A further object of the present invention is to provide a device of this type which will enable the golfer to check as to whether or not he has in fact properly executed the stroke.

In addition, it is an object of the present invention to provide a device of this type which is of a relatively simple rugged construction composed primarily of electronic components.

According to the invention the tee-off device includes a plurality of light-source means which are of different colors and which are situated so as to be visible to the golfer while the golfer is executing a golf stroke. A tee means is provided for supporting a golf ball which is adapted to be driven by the golfer, and this tee means is movable automatically between a ball-supporting condition and an empty condition which is assumed automatically by the tee means when a golf ball is driven therefrom. A preparatory circuit means is operatively connected with the plurality of light-source means for sequentially placing the latter in a condition ready to be energized as long as the tee means is in the ball-supporting condition thereof. An operating circuit means is operatively connected with the tee means and the plurality of light-source means to cooperate with the preparatory circuit means to energize only that one of the plurality of light-source means which is in a condition ready to be energized at the instant when the golf ball is driven from the tee means, which is to say at the instant when the latter automatically assumes its empty condition. Thus at the instant of driving the golf ball there will be a momentary flash of illumination of a given color visible to the golfer only if he has maintained his eyes properly on the golf ball, and the golfer by detecting this color will know that he has not improperly raised his head prior to striking the golf ball. A checking circuit means is operatively connected with the operating circuit means to be manually operated by the golfer subsequent to driving the golf ball for checking as to whether or not the proper color has been detected.

BRIEF DESCRIPTION OF DRAWINGS

The invention is illustrated by way of example in the accompanying drawings which form part of this application and in which.

DESCRIPTION OF PREFERRED EMBODIMENTS

Figure 1A:
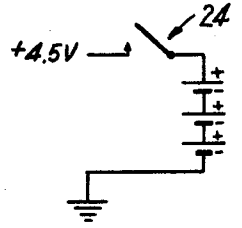
FIG. 1A is a wiring diagram of the circuitry used for energizing the circuitry shown in FIG. 1.
Figure 1:
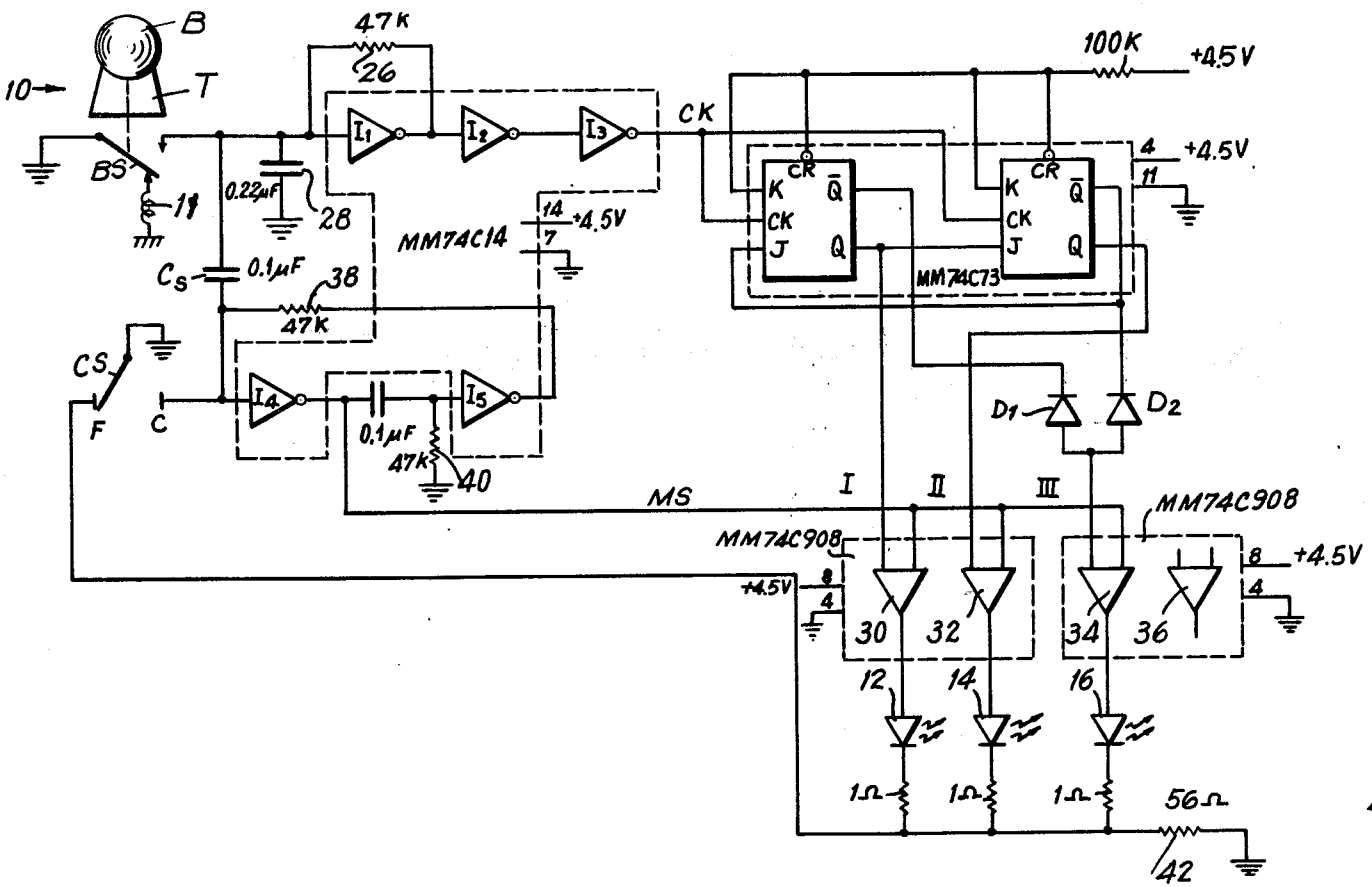
FIG. 1 is a wiring diagram of one possible electronic circuit according to the invention.

Referring now to FIG. 1, there is shown at the upper left part thereof a tee means 10 which includes the schematically illustrated tee T which is situated over and is operatively connected to a switch BS which forms part of the tee means 10. The tee T is shown carrying the schematically illustrated golf ball B. A spring 11 is schematically shown operatively connected with the switch BS for urging the latter to its closed position. However, the arrangement is such that when the ball B is carried by the tee T the weight of the ball is sufficient to cause the spring 11 to yield so that the switch BS assumes the open condition shown in FIG. 1. Thus the tee means 10 is shown in FIG. 1 in a ball-supporting condition where the switch BS of this tee means 10 automatically assumes an open position, whereas when the golf ball B is driven from the tee T, the tee means 10 assumes an empty condition enabling the spring 11 to expand so that the switch BS automatically assumes its closed position. Of course, this construction is schematically illustrated in FIG. 1. This structure may be in the form of the mechanical arrangement similar to that shown in the above application. Thus, for example, the tee T may be mounted on a platform carried by a vertical shaft which is vertically movable in a suitable guide and which is biased to its upper position by way of a spring or counterweight carried by a lever which is connected to the vertically movable shaft, so that the platform and tee assume their upper position automatically when no ball is carried by the tee, while the shaft and platform assume their lower position, as disclosed in the above application, when a ball is carried by the tee. Of course with this arrangement the switch BS will assume the open and closed positions, corresponding to the ball-supporting and empty conditions of the tee means 10. Thus the shaft of the above application may be operatively connected with a switch to close the latter when there is no ball on the tee and to open the switch when the ball is carried by the tee, this switch of course corresponding to the switch BS.

Figure 2:
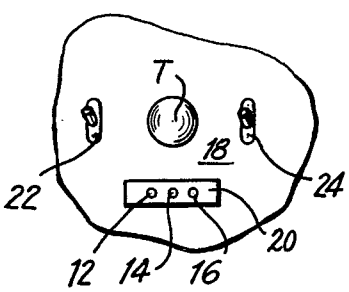
FIG. 2 is a schematic representation showing in a top plan view how the tee and a plurality of light-source means as well as switches of the invention appear to the golfer when the golfer looks down toward the tee which is adapted to carry the golf ball.

FIG. 2 illustrates how the tee T is visible to the operator when the operator looks down toward the tee. As is apparent from FIG. 2, there is situated adjacent to the tee T a plurality of light source means 12, 14, and 16 which are in the form of light-emitting diodes of respectively different colors. The tee T projects above a wall 18 of a suitable housing which carries the structure shown in FIG. 1, and this horizontal wall 18 is formed with an opening 20 through which the light-source means 12, 14, 16 are visible. There is also accessible at the top wall 18 of the housing a pair of switches 22 and 24 for a purpose referred to below. Of course the plurality of light source means 12, 14, and 16 are suitably protected as being situated beneath a transparent clear glass window or the like which closes the opening 20 of the top wall 18 of the housing which is situated in a suitable opening formed in the ground at the green where the tee T is located.

Returning to FIG. 1, it will be seen that the switch BS has one side connected to the ground while the other side is connected to the input of an IC of the type MM74C14. This latter IC forms part of a preparatory circuit means operatively connected with the plurality of light source means 12, 14, and 16 for sequentially placing the latter in a condition ready to be energized. By way of a resistor 26 of 47 kOhms and a capacitor 28 of 0.22 $\mu$F, an oscillator is formed, with the three inverters $I_1$, $I_2$, and $I_3$ of the IC, in a manner which is known per se. This oscillator provides an output signal CK serving as a clock signal for an IC of the type MM74C73 which also forms part of the preparatory circuit means and which includes a flip-flop means in the form of two J-K flip-flops.

A voltage of + 4.5 volts is permanently applied to both of the K-inputs ("1") of the flip-flops. The source of this voltage is indicated in FIG. 1A, which shows the source of energy, the conductor at the upper left of FIG. 1A being electrically connected with the circuitry of FIG. 1 to energize the latter to provide the clock signal CK while the tee means 10 is in the ball-supporting condition shown in FIG. 1. FIG. 1A also shows the switch 24 which is closed by the operator in order to render the entire circuitry operative. When the structure is not used this switch remains open. When the operator approaches the tee he will close the switch 24 so as to render the device of the invention operative.

The J-input of the left flip-flop shown in FIG. 1 is connected to the $\overline{Q}$-output of the right flip-flop shown in FIG. 1. The J-input of this right flip-flop is electrically connected to the Q-output of the other flip-flop.

The pair of $\overline{Q}$-outputs of the pair of flip-flops are interconnected by way of a pair of reverse-biased diodes $D_1$ and $D_2$ so as to form an output III. The Q-output of the left flip-flop of FIG. 1 forms an output I and the Q-output of the other flip-flop forms an output II. Upon application of the clock signal CK to this flip-flop means, the outputs I, II, and III will sequentially become momentarily high ("1"), which is to say these outputs will become sequentially operative, and this sequential operation is repeated as long as the clock signal continues.

These sequentially operated outputs I, II, and III are respectively connected to inputs of a buffer circuit which is part of an IC of the type MM74C908. These buffer circuits include the AND gates 30, 32, 34, 36, and the gates 30, 32, and 34 respectively connected operatively with the light-emitting diodes 12, 14, and 16, so that the latter are sequentially placed by the preparatory circuit means described above in a condition where at any given instant one of these light-emitting diodes is ready to be energized. Of course, additional light-source means may be provided, and the added AND gate 36 is shown for this purpose.

An operating circuit means is operatively connected to the tee means 10 as well as to the plurality of light source means 12, 14, 16 for cooperating with the above-described preparatory circuit means for energizing a particular one of the plurality of light-source means at the instant when the tee means 10 assumes its empty condition. This operating circuit means includes a monostable multivibrator formed by the inverters $I_4$ and $I_5$ of the IC MM74C14, this operating circuit means also including a capacitor $C_s$ of 0.1 $\mu$F and a pair of resistors 38 and 40 each of 47kOhms. Thus this operating circuit means in the form of the monostable multivibrator applies the output signal MS to the AND gates of the preparatory circuit means, the operating circuit means being connected through these gates to the several light-source means. It will be seen that the capacitor $C_s$ is electrically connected to the switch BS together with the preparatory circuit means.

Thus, with the structure described above when a ball is driven from the tee, the switch BS will automatically assume its closed position, and the monostable multivibrator receives an initiating pulse through the capacitor $C_s$ as the switch BS forms a connection to ground. As a result the output MS becomes high ("1") for a short period of time, for example on the order of 0.1 sec, so that for this short mementary interval the signal MS is simultaneously delivered to all of the AND gates 30, 32, and 34. At this particular instant when the signal MS is simultaneously received by these gates, one of the gates is receiving one of the outputs I, II, or III, so that a particular one of the gates 30, 32, and 34 will simultaneously receive signals both from the preparatory circuit means and the operating circuit means, thus energizing that one of the light-source means 12, 14, and 16 which is electrically connected with the particular one of the AND gates which simultaneously receives both signals. In this way the associated buffer circuit produces an output signal which causes the light-emitting diode connected to this output to emit a short momentary flash of light of a particular color. Of course the several diodes 12, 14, and 16 emit light of different colors.

If the golfer has not raised his head from the ball at the instant of impact with the club, the operator will see a momentary flash of light of a particular color.

When the ball is driven from the tee means 10 the switch BS closes as described above, and no further clock pulses CK are generated. The three outputs I, II, and III maintain their output levels ("1" or "0") as they were at the instant when the ball was driven from the tee. This situation may be used to enable the player to check as to whether or not the light flash of a given color has been correctly observed.

For this latter purpose a checking circuit means is provided, this latter circuit means including the check switch CS which forms the switch 22 shown in FIG. 2. This switch normally engages the contact F shown in FIG. 1 so that through this contact the resistor 42 of 56 ohms is grounded. When the operator manipulates the switch CS (22) so as to displace it from the contact F and place it in engagement with the contact C, the checking circuit which includes this switch is in its checking position energizing the operating circuit means so as to provide the output MS. Thus in this way it is possible manually to provide the output MS which becomes high ("1"), so that the particular light source means which previously was momentarily energized is now continuously energized while the switch 22 is operated, which is to say while the switch CS is in engagement with the contact C. It will be noted that at this time the resistor 42 of 56 ohms is connected in series with the several light-emitting diodes so as to prevent them burning out inasmuch as during the checking operation these light-emitting diodes will remain energized for a longer than usual interval.

Of course, when the operator has checked to determine as to whether or not a light flash of a proper color has been properly detected, the operator will return the switch 22 or CS to the position shown in FIG. 1, and upon placing another ball B on the tee T, the above-described structure is again ready to be operated in a manner described above.

Thus, in the above-described manner it is possible for a golfer to practice driving balls from the tee T, with the above cycle of operations being repeated each time a ball is driven from the tee, and the above structure remains operative as long as the switch 24 remains closed. When the structure is not to be used this switch is of course opened as set forth above.

What is claimed is:

1. A tee-off device comprising tee means for supporting a golf ball which is to be driven from said tee means, said tee means having a pair of conditions one of which is a ball-supporting condition assumed by said tee means when the golf ball is supported thereby and the other of which is an empty condition different from said ball-supporting condition and automatically assumed by said tee means when a golf ball is driven therefrom, a plurality of light-source means situated adjacent said tee means at a location where any one of said light-source means when energized is visible to a golfer driving a golf ball from said tee means, said plurality of said light-source means respectively providing light of different colors when energized, preparatory circuit means operatively connected with said plurality of light-source means for placing the latter in a condition remaining unenergized but ready to be energized in such a way that at any given instant only one of said light-source means is in a condition ready to be energized with the condition of being ready to be energized being transferred among the plurality of light-source means so that at any given instant the operator cannot know which of the differently-colored light-source means is in a condition ready to be energized, said tee means cooperating with said preparatory circuit means for rendering the latter operative only while said tee means is in said ball-supporting condition thereof, and operating circuit means operatively connected to said plurality of light-source means and said tee means for cooperating with said preparatory circuit means to energize momentarily in a haphazard manner only that one of said light-source means which happens to be in said condition ready to be energized when said tee means assumes said empty condition thereof upon driving of a golf ball therefrom, the location of the plurality of light-source means being such that the momentarily energized light-source means will only be visible to the golfer when he is properly positioned with respect to the golf ball carried by said tee means, whereby upon detecting a particular color from that one of said light-source means which has been haphazardly energized the golfer will know that he remained properly positioned up to the time when the golf ball has been driven.

2. The combination of claim 1 and wherein said prepartory circuit means cooperates with said plurality of light-source means for sequentially placing the latter in the condition ready to be energized by way of said operating circuit means when said tee means assumes said empty condition thereof.

3. The combination of claim 1 and wherein a manually operable checking circuit means is operatively connected with said operating circuit means for manually rendering the latter operative to energize again the particular light-source means which was momentarily energized when said tee means assumed said empty condition thereof, so that the golfer can check as to whether or not the particular color was properly detected.

4. The combination of claim 3 and wherein said preparatory circuit means cooperates with said plurality of light-source means for sequentially placing the latter in the condition ready to be energized.

5. The combination of claim 3 and wherein said checking circuit means includes a manually operable switch operatively connected with said operating circuit means for manually rendering the latter operative.

6. The combination of claim 5 and wherein a protecting resistor is operatively connected with said plurality of light-source means, said manually operable switch of said checking circuit means when disconnected from said operating circuit means being operatively connected with said resistor for grounding the latter while rendering said resistor operative when said checking circuit means is manually operated to render said operating circuit means operative.

7. The combination of claim 1 and wherein said tee means includes a switch means having a pair of positions one of which is a closed position and the other of which is an open position, said pair of positions of said switch means being automatically assumed thereby when said tee means is in said ball-supporting and empty conditions, respectively.

8. The combination of claim 7 and wherein said switch means assumes said closed position thereof when said tee means is in said empty condition thereof.

9. The combination of claim 1 and wherein said preparatory circuit means includes a plurality of AND gates respectively connected operatively with said plurality of light-source means and respectively being placed in said condition ready to energize said plurality of light-source means one at a time in a haphazard manner by way of said preparatory circuit means so that at any given instant only one of the light-source means is in a condition ready to be energized, and said operating circuit means also being operatively connected with said plurality of AND gates, and simultaneously transmitting signals to all of said gates when said tee means assumes said empty condition thereof upon driving of a ball therefrom, so that only that particular gate which at a given instant places a particular one of said light-source means in a condition to be energized will simultaneously receive the signals from said preparatory and operating circuit means to energize a particular one of said light-source means.

10. The combination of claim 9 and wherein said preparatory circuit means includes a flip-flop means operatively connected with said gates for acting on the latter to place the plurality of light-source means only one at a time in the condition ready to be energized.

11. The combination of claim 1 and wherein said plurality of light-source means are in the form of a plurality of light-emitting diodes respectively of different colors.

* * * * *